United States Patent [19]

Batzer et al.

[11] Patent Number: 4,475,349

[45] Date of Patent: Oct. 9, 1984

[54] CONTINUOUSLY PUMPING AND REACTIVATING GAS PUMP

[75] Inventors: Thomas H. Batzer, Livermore; Wayne R. Call, Tracy, both of Calif.

[73] Assignee: The United States of America as represented by the United States Department of Energy, Washington, D.C.

[21] Appl. No.: 476,309

[22] Filed: Mar. 17, 1983

[30] Foreign Application Priority Data

Mar. 18, 1982 [JP] Japan ..... 57-041682

[51] Int. Cl.[3] ..... B01D 8/00

[52] U.S. Cl. ..... 62/55.5; 55/269; 62/268; 417/901

[58] Field of Search ..... 62/55.5, 100, 268; 417/901; 55/269

[56] References Cited

U.S. PATENT DOCUMENTS

| | | | |
|---|---|---|---|
| 2,757,840 | 8/1956 | Wiessenber et al. | 62/55.5 |
| 3,137,551 | 6/1964 | Mark | 62/55.5 |
| 3,175,373 | 3/1965 | Holkeboer et al. | 62/55.5 |
| 3,210,915 | 10/1965 | Kraus | 62/55.5 |
| 3,264,803 | 8/1966 | Read | 62/55.5 |
| 3,352,122 | 11/1967 | Rothenberg et al. | 62/55.5 |
| 3,574,950 | 4/1971 | Dantoni | 62/55.5 |
| 3,579,997 | 5/1971 | Rapinat | 62/55.5 |
| 3,579,998 | 5/1971 | Thibault | 62/55.5 |
| 4,072,025 | 2/1978 | Thibault | 62/55.5 |
| 4,198,829 | 4/1980 | Carle | 62/55.5 |
| 4,275,566 | 6/1981 | Bonn | 62/55.5 |
| 4,295,338 | 10/1981 | Welch | 62/55.5 |
| 4,341,079 | 7/1982 | Bonn | 62/55.5 |

OTHER PUBLICATIONS

Damm et al.: "Preliminary Design of a Tandem-Mirror-Next-Step Facility", UCRL-53060.

*Primary Examiner*—Ronald C. Capossela
*Attorney, Agent, or Firm*—L. E. Carnahan; Roger S. Gaither; Michael F. Esposito

[57] ABSTRACT

Apparatus for continuous pumping using cycling cyropumping panels. A plurality of liquid helium cooled panels are surrounded by movable nitrogen cooled panels the alternatively expose or shield the helium cooled panels from the space being pumped. Gases condense on exposed helium cooled panels until the nitrogen cooled panels are positioned to isolate the helium cooled panels. The helium cooled panels are incrementally warmed, causing captured gases to accumulate at the base of the panels, where an independent pump removes the gases. After the helium cooled panels are substantially cleaned of condensate, the nitrogen cooled panels are positioned to expose the helium cooled panels to the space being pumped.

15 Claims, 10 Drawing Figures

CONTINUOUSLY PUMPING AND REACTIVATING GAS PUMP

DESCRIPTION

The present invention relates generally to gas pump apparatus in which gas is removed from a space through capture by gas pumping members and, more particularly, to a gas capturing pump apparatus having sets of gas pumping members which are separately isolatable for reactivation from the space from which gas is removed.

Cryogenic gas pumping apparatus, which will hereinafter sometimes be referred to as cryopumps, have the advantage of functioning without a working fluid exposed to the vacuum. Cryopumps remove gas from a space by capturing the gas on gas pumping members placed in gas flow communication with the space. Cryopumps rely on condensation of the gas on a temperature controlled surface. In such devices, pumping occurs as long as the operating pressure of the space proximate the gas pumping member surface is higher than the saturated vapour pressure at the temperature of the surface. While cryogenic gas pumping apparatus do not suffer from the backflow contamination produced by a foreign working fluid substances as in diffusion and turbomolecular transport pumps, they have not heretofore been capable of continuous pumping without periodically exposing the space being pumped to contamination from previously captured gas, which is a form of backflow. More specifically, as will be appreciated from the foregoing, cryopumps do not remove the pumped gas from the pump system, but attach gas to a surface in the system. Condensation pumping stops when the thermodynamic equilibrium between the condensate covered pumping surface and the pumped gas' saturated vapour pressure is reached. Ordinarily, however, such pumps become ineffective before such condition is reached, because the increasing captured gas load placed on the pumps reduces the pumping efficiency of cryopumps to the extent that the rate of removal of gases from the space being pumped is too low for effective pumping of the space. It is this gas load on the gas pumping members and the high rate at which it can accrue that has limited the use of cryopumps for continuous operation in high vacuum applications such as in thermonuclear fusion apparatus.

In addition, for some applications, such as thermonuclear fusion reactors, the gases condensing on the gas capturing members may be radioactive or expensive non-consumed fuel gases, like tritium. In these applications it is desirable to minimize the inventory of such gases held in the condensed state on the gas pumping members. Reducing such an inventory leads to cost effective recycling of fuel and increased safety margins in fusion apparatus use.

Therefore, to effect efficient continuous pumping of a space with a condensation pumping system or reduce inventory, it is necessary to reactivate the pumping surfaces. Reactivation is a process that liberates the captured gas species to return the pumping surfaces to a state of optimum pumping performance. The captured gas species are liberated by warming the pumping surfaces and exhausting liberated gases to the exterior of the space being pumped by a mechanical pump. The reactivation process is often carried out whenever the pumping speed of the system, hence, pumping efficiency, is reduced below an acceptable level as a result of the captured gas load on the pumping surfaces approaching their gas capturing capacity. In addition, the reactivation process is also often performed on a periodic basis regardless of the pumping speed of the system. In either case, the gas pumping operations of available condensation gas capturing pumps are interrupted during the reactivation process and many of the available pumps are reactivated without isolation of the pumping members from the space being pumped.

Interruption of the gas pumping operations hinders maintenance of a desired steady state pressure in the space being pumped. Maintenance of a steady state pressure is becoming increasingly important in plasma containment devices, such as thermonuclear fusion reactors, which are characterized by atmosphere of extremely pure low neutral gas densities. Present thermonuclear fusion machines being designed to operate in a steady state pressure mode require large gas throughput to achieve the desired atmosphere. This requires vacuum pumping systems also having steady state capability as well as a large gas throughput, backflow and pumping speed characterics productive of the desired steady state pressure operating condition. gases undesirably and harmfully contaminates the gas atmosphere of the reactor grade plasma. Such contamination leads to inefficient operation of the fusion machine by virtue of heat losses and can prevent loss of proper plasma conditions for sustained fusion reactions, if the backflow is excessive.

Several approaches to the maintenance of steady state pressure conditions have been implemented, but all are found wanting in one or more respects. A common approach is a system of multiple appendaged vacuum pumps having at least two valve isolated vacuum pump stages, with each stage adapted to achieve a desired pressure level in the vessel to be evacuated. The vacuum pump stages are sequentially coupled in gas flow communication, i.e., a coupling that provides an unimpeded path for the transmission or flow of gas, with the vessel through the appropriated manipulation of the isolation valves. While such systems are capable of initially achieving a desired final pressure on a continuous pumping basis, the final vacuum pump stage is unable to maintain the final pressure without reactivation of the gas pumping members. If the pumping members are not isolated from the vessel being pumped during reactivation, the aforedescribed undesirable backflow to the vessel results. Alternatively, if the pumping members of the final vacuum stage are isolated, the pumping of the vessel is undesirably interrupted. An exemplary multiple appendaged vacuum pump system of this type is described in U.S. Pat. No. 2,757,840 to Gustav Weissenberg et al.

Another multiple appendaged vacuum pump system is described in U.S. Pat. No. 3,264,803 to Philip L. Read. As discussed with reference to the Weissenberg et al patent, the vessel being pumped is disconnected from the Read vacuum pump system while the final sorption pump stage is reactivated to liberate and exhaust captured gas. Consequently, the vacuum pump system described in the Read patent is characterized by the same shortcomings discussed with reference to the Weissenberg et al patent.

A plurality of appendaged vacuum pumps often are used to avoid interruption of the pumping of a vessel so that a desired final pressure can be maintained in the vessel on a continuous basis. This has been achieved by coupling each appendaged pump to the vessel through a separate isolation valve and operating the valves so that one appendaged pump is always coupled to pump the vessel while the other appendaged pumps are isolated for reactivation. In such multiple appendaged pump systems, each appendaged pump must have a pumping capacity capable of maintaining the vessel at the desired final pressure. While such pump systems avoid undesirable interruption of pumping of the vessels and backflow to the vessel discussed above with respect to the Weissenberg et al. and Read patents, they are characterized by duplication of pumps, pump capacity and isolation valves, being large in size and requiring manipulation of several system controls in the proper sequence, all of which make such systems undesirable, particularly, for use in sustained fusion reaction machines.

A two stage cryogenic pumping apparatus is described in U.S. Pat. No. 4,295,338 to Kimo M. Welch in which the pumping members are removed and replaced when they become contaminated. This necessarily requires returning the pumped vessel to atmosphere. Of course, this prevents operating the cryogenic pumping apparatus described in the Welch patent on a continuous pumping basis.

A two stage combined condensation and sorption pump is described in the U.S. Pat. No. 4,198,829 to Jacques Carle in which the condensation stage surrounds and shields the sorption stage until only incondensable gas species remain in the vessel being pumped. Once this condition is reached, the pumping members of the condensation stage are moved to expose the pumping members of the sorption stage, which capture and remove the incondensable residual gas species remaining in the vessel. The final pressure of the vessel is determined by the sorption stage. Therefore, the sorption stage must remain in continuous gas flow communication with the vessel and continue effective pumping of the vessel, if the final pressure is to be maintained under vessel operation conditions which continuously produce unwanted contaminents. Should the sorption stage approach its gas capturing capacity, it will be unable to maintain the desired final pressure level in the vessel. If reactivation is attempted with the two stage pump in gas flow communication with the vessel being pumped, the liberated gas will flow back into the vessel, contaminating the vessel space and altering the pressure therewithin. Even if backflow of liberated gas to the vessel could be avoided, the sorption stage would not continue effective pumping of the incondensable gas species during the reactivation process. Consequently, the desired final pressure level of the vessel would not be maintained by a two stage pump constructed and operated in accordance with the teachings of the Carle patent.

U.S. Pat. No. 3,210,915 to Thaddaus Kraus describes a sluicing sorbent gas pumping apparatus capable of continuously pumping a space without interruption for reactivation operations or exposing the pumped space to contaminants liberated by reactivation of the pumping medium. However, in accordance with the teachings of the Kraus patent, such continuous pumping is achieved by the cumbersome technique of delivering a continuous stream of loose, granular sorbent through a pump chamber in gas flow communication with the space being pumped. Not only is the technique cumbersome and fraught with difficulties of implementation, such technique imposes severe limitations on the use of the pumping apparatus, particularly, with respect to its physical orientation. More specifically, the pumping apparatus must be arranged in an orientation relative to the flow of the stream of loose, granular sorbent material so that the flow is restricted to the desired path and the material is prevented from straying throughout the pump system and pumped vessel.

The present invention is a gas pump apparatus for removing gas species from a space which includes a structure defining a plurality of gas pumping surfaces at least one of which is isolatable from the space for reactivation while the other of the plurality of surfaces remain in gas flow communication with the space for continued pumping of the space unaffected by the reactivation of the isolated pumping surface or surfaces. As used herein, the term isolatable or other forms of isolate when used to specify separation from a space being pumped means a setting apart from the space under a gas seal condition that prevents undesirable gas flow into the space from the isolated zone. As will become more apparent upon consideration of the following detailed description of preferred embodiments of the gas pump apparatus of the present invention, a seal provides the desired isolation between the space forming an impedance to gas flow from an isolated gas pumping surface to the space being pumped which limits any flow of captured gas back to the space during reactivation to an insignificant level, namely, no more than a few percent of the captured gas load of the isolated gas pumping surface being activated, and the isolated gas pumping surfaces. Such isolation permits uninterrupted or continuous pumping of the space without need to replace pumping surfaces or to expose the pumped space to unacceptable backflow of gas species liberated from pumping surfaces being reactivated. Moreover, as will be appreciated from the description of the preferred embodiments of the gas pump apparatus of the present invention, the aforedescribed limitations and cumbersomeness characterizing continuous sluicing gas pump apparatus, such as described in the aforementioned Kraus patent, are avoided by the structure of the gas pump apparatus of the present invention. Such desirable features are realized in the gas pump apparatus of the present invention in a relatively compact structural arrangement that is not limited as to configuration or physical orientation and avoids substantial duplication of gas pumping equipment and the requirement to manipulate several system controls in operating the apparatus to achieve and maintain a steady state pressure condition in the space being pumped.

The foregoing and other features and advantages of the gas pump apparatus of the present invention will become more apparent upon consideration of the following detailed description of preferred embodiments of the invention and appended claims taken together with the accompaning drawings in which:

Figure 1:
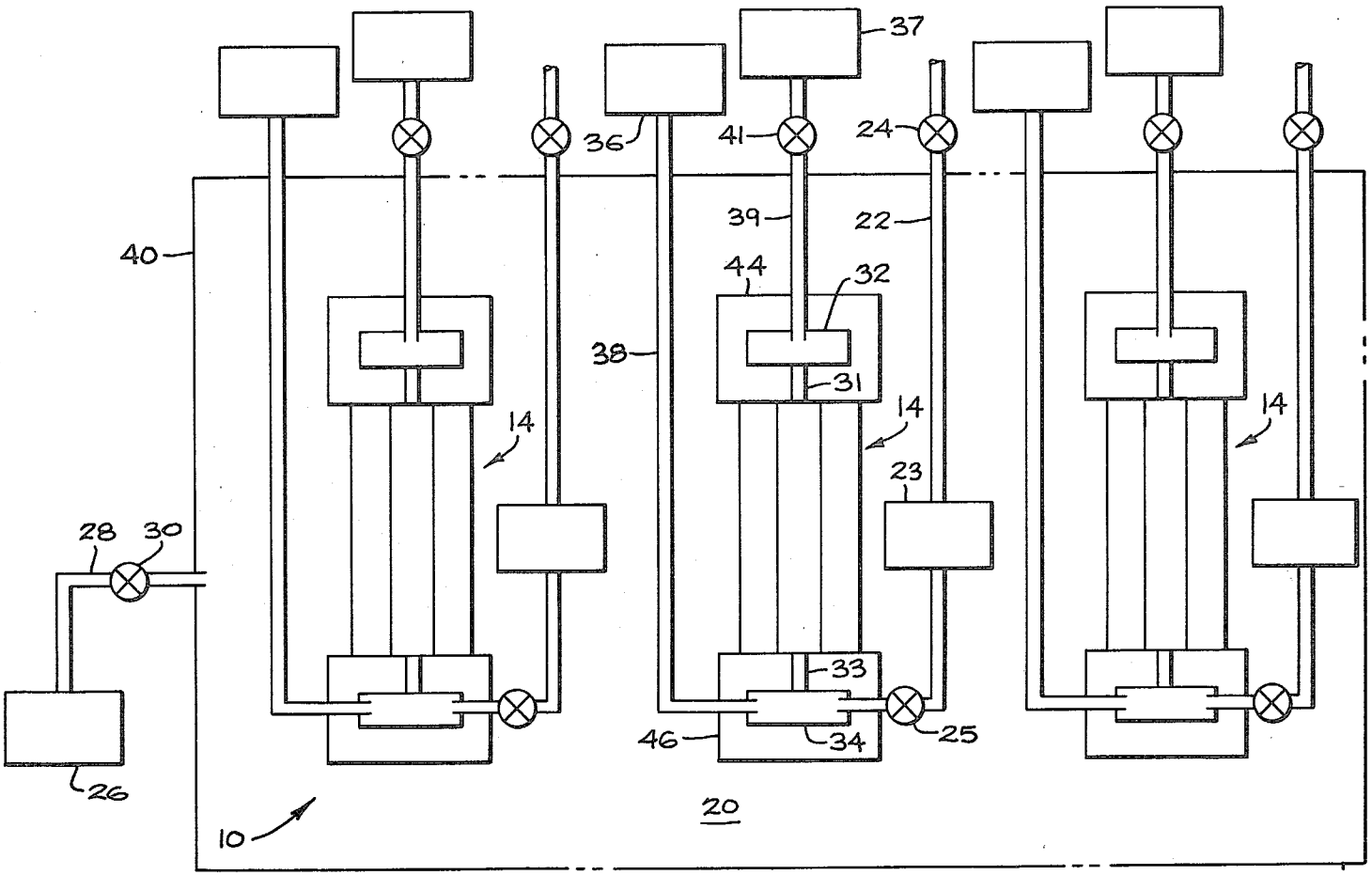
FIG. 1 is a schematic diagram of a vacuum pump system employing the gas pump apparatus of the present invention interrupted along its length to facilitate its illustration.
Figure 2A:
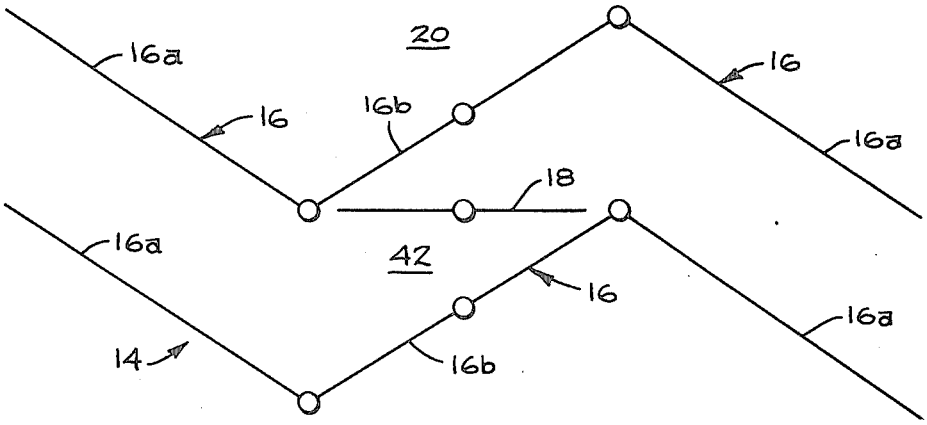
FIGS. 2A and 2B are schematic diagrams illustrating the gas pumping member isolated technique as implemented in the preferred embodiment of the present invention.
Figure 2B:
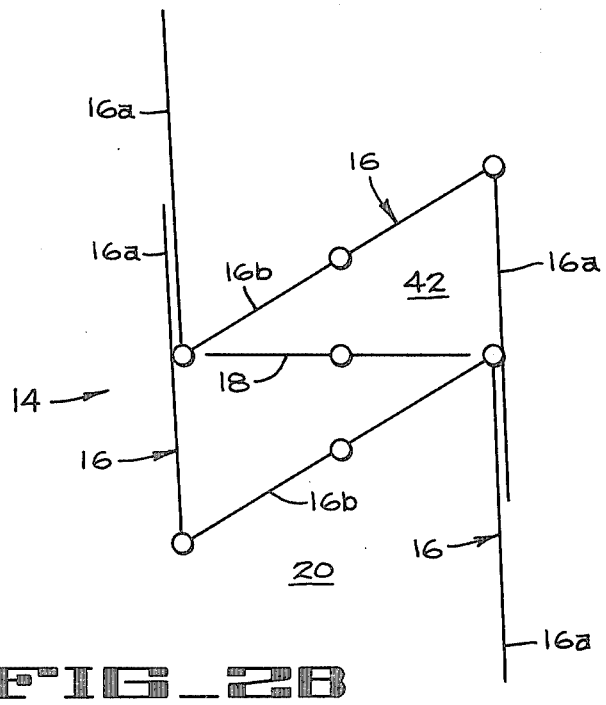

Broadly and with reference to FIGS. 1 and 2, the gas pump apparatus 10 of the present invention includes a plurality (three of which are seen in FIG. 1) of gas pumping assemblies 14, each including shield members 16 and gas capture pumping members 18 (FIGS. 2A and 2B) disposed in gas flow communication with a space 20 containing an atmosphere of gas to be pumped and maintained at a selected final pressure. The gas pump apparatus 10 of the present invention will be described in detail with reference to a preferred embodiment illustrated in FIGS. 3-9 in which gas condensing pumping members 18 protected by thermal shield members 16 are arranged to evacuate the space 20 to and maintain it at an ultrahigh vacuum for an extended period suitable for continuously sustaining thermonuclear fusion reactions in a prolonged steady state pressure mode. For such applications, the gas pump apparatus 10 is fabricated, configured and dimensioned for high gas volume vacuum pumping operations. It will be appreciated, however, the gas pump apparatus 10 of the present invention is suited for other vacuum pumping applications not as demanding as such thermonuclear fusion applications and for gas pumping applications at higher pressures. Moreover, gas capturing elements that rely on gas capturing mechanisms other than cryogenic whose pumping performance is enhanced or is dependent upon reactivation of the elements can be employed in the apparatus 10 of the present invention. For applications other than that for which the preferred embodiment of the gas pump apparatus 10 is arranged, the pump apparatus is fabricated, configured and dimensioned according to the needs of the application. For example, for pumping spaces at elevated pressures, sorption or getter gas pumping members 18 are preferred over cryogenic gas condensing pumping members.

In addition to communicating with the space 20, each gas pump assembly 14 is coupled in gas flow communication via a gas exhaust duct 22 and gas exhaust valve 24 with an auxiliary exterior gas pump exhaust apparatus of conventional design (not shown) for exhausting captured gases liberated for the gas capture pumping members 18 during reactivation of the members in the manner permitted by the gas pump apparatus 10 of the present invention. Reactivation of the pumping members is assisted by the use of a gas collector pump 23, typically a liquid helium cooled surface, located between gas pump apparatus 10 and the exterior gas pump exhaust apparatus. Collector pump 23 is operable to effect rapid transfer, at elevated pressures of gases that are liberated from the gas capture elements of the primary gas capture pump apparatus during reactivation of the gas capture elements. The transferred gases are held by the gas collector pump for convenient exhausting to the exterior without effecting the operation of the primary gas pump apparatus. An isolation valve 25 is placed in the gas duct between the collector pump 23 and gas capture pump apparatus 10 so that the pump apparatus can be isolated from the gas exhaust system except during transfer of liberated gases to the exhaust system.

To facilitate rapid pumping of the space 20 to the desired final pressure and maintaining that pressure for prolonged periods, it is desirable to fore pump the space 20 to an initial medium pressure i.e., about $1\times10^{-3}$ torr. Usually this is accomplished by an exterior diffusion pump apparatus 26 of conventional design communicated with space 20 via fore pump duct 28 and fore pump valve 30.

In the preferred embodiment of the gas pump apparatus 10 of the present invention, reactivation of the gas capture pumping members 18 is accomplished by controlling the temperature of the members. The preferred embodiment utilizes cryogenic pumping elements to effect the desired removal of gas species from the space 20, and the temperature of the cryogenic gas pumping members 18 is controlled by altering the delivery of cooling fluid to the pumping members. For this purpose, two local coolant reservoirs 32 and 34 are located at opposite ends of the coolant flow path through the cryogenic gas pumping members and cooperate with a pressurized source 37 of compatible gas to control the delivery of coolant to pumping members. In the preferred embodiment, the pumping members 18 (FIGS. 2A and 2B) of the plurality of gas pumping assemblies 14 (FIG. 1) are sequentially subjected to reactivation in a manner so that the gas pumping members of at least one of the assemblies are always exposed by their associated shield members 16 to pump the space 20, while the pumping members of at least one other of the assemblies are isolated by shield members for reactivation. More particularly, the opposite ends of the pumping members 18 of each assembly 14 are joined to the two local coolant reservoirs 32 and 34 by coolant ducts or tubes 31 and 33, respectively. Coolant is delivered from a coolant storage reservoir 36 via coolant duct 38 to the lower most local coolant reservoir 34. After filling, the lower most reservoir 34 transmits coolant through the gas capture pumping members 18 via tube 33 and fills the upper most local coolant reservoir 32 via tube 31. Pressurizing the upper local reservoir 32 with a suitable gas compatible with the coolant drives the coolant out of the upper local reservoir, the pumping members 18 and the lower local reservoir 34 back to the storage reservoir 36. Such controlled pressurizing is accomplished by the operation of a conventional pressurized source 37 of the compatible gas coupled by the gas duct 39 and the isolation valve 41 in gas flow communication with the upper local reservoir 32. The removal of coolant from the pumping members 18 causes a rise in the temperature of the members and results in the liberation of captured gas, hence, reactivation of the members. Shrouds 44 and 46 surround the local coolant reservoirs 32 and 34 and the opposite ends of the gas capture pumping members 18 and serve to conduct the liberated gases to the exhaust system via the exhaust valve 25 and prevent the liberated gases from backflowing to the space 20. The liberated gases are collected by the collector pump 23 and exhausted through the gas exhaust duct 22 as previously described.

Coordinated operation of the shield members of the plurality of gas pumping assemblies 14 and the pressurized sources 37 permits the reactivation of the gas pumping members 18 without interruption of pumping the space 20. In the embodiment of FIG. 1, the shield members 16 of one of the plurality of gas pumping assemblies 14 are positioned as illustrated in FIG. 2B to isolate the associated gas pumping members 18 from the space 20 in the zone 42, while the shield members of the other assemblies are positioned as illustrated in FIG. 2A to expose the associated gas pumping members to the space so that pumping of the space continues. The pressurized source 37 and isolation valve 41 operatively associated with the gas pumping assembly 14 whose gas pumping members 18 are isolated in the zone 42 for reactivation are operated to drive coolant from the gas pumping members as described hereinbefore, while the pressurized sources and isolation valves operatively associated with the other gas pumping assemblies are operated to permit coolant to enter the associated gas pumping members. After the gas pumping members of one of the assemblies 14 have been reactivated, they are exposed to pump the space 20 in place of those of another gas pumping assembly that are isolated for reactivation. The gas pumping members 18 of the other gas pumping assemblies 14 are similarly reactivated and substitute in sequence and thereafter the reactivation and substitution sequence is repeated. Isolating the gas pumping members of the plurality of gas pumping assemblies 14 in a repeating sequence permits continuous pumping of the space 20, because unsaturated gas pumping members providing the required pumping capacity to maintain the space 20 at the desired pressure are always exposed in gas flow communication with the space.

Since some of the gas pumping members are isolated for reactivation while others are pumping the space 20, the gas pumping apparatus 10 of the present invention requires a total pumping capacity in excess of that required to maintain the space at a desired pressure. However, the excess pumping capacity required is only a fraction of that required to maintain the space 20 at the desired pressure. For large plasma confinement chambers characterized by high flow rates of a deuterium gas and operating vacuum pressures of about $1\times10^{-8}$ torr, an excess pumping capacity in the range of ten to twenty percent is satisfactory. This is much less than a typical 100 percent excess capacity as required in a multiple appendage pump apparatus. For a given application of gas pumping apparatus 10, the excess capacity is a function of the time required to reactivate a pump-area unit of gas pumping members 18 i.e., reactivate the excess capacity, and the predetermined maximum amount of captured gas from space 20 that is allowed to reside on gas pumping apparatus 10 at any time. Smaller amounts of captured gas residing as inventory on gas pumping apparatus 10, greater reactivation times or lesser pumping times between successive reactivations for gas pumping members 18, would require greater excess pumping capacity. Of course, lesser excess pumping capacity is required if the demands of such parameters are opposite as specified.

It should be appreciated from the foregoing that the gas pumping apparatus 10 of the present invention offers the advantages of being able to achieve the desirable continuous pumping of a space 20 without removing the apparatus from gas flow communication with the space for reactivation and without duplication of gas pumping apparatus other than the addition of a little excess pumping capacity. Such advantages are desirable in most all gas pumping applications and forms of gas pumping apparatus. However, they are particularly attractive for wall-type gas pumping apparatus (more commonly called "wall pumps"), especially such apparatus constructed to pump large spaces. A wall pump is disposed within the space being pumped and, usually, is constructed either to be mounted on the walls of the structure defining the space being pumped or to form part of the walls of such structures. Since wall pumps are disposed within the space being pumped, connecting valves (such as used to connect appendaged gas pumping apparatus to the space being pumped) are unnecessary. Where the gas throughput of the gas pumping apparatus must be high, the connecting valves must be large. Such valves are expensive, complex and undesirable. While wall pumps enable avoidance of the need of large valves, reactivation of such pumps has, in the past, required interruption of the pumping of the space and exposure of the space to contamination by gases liberated during the reactivation of the wall pumps. The features of the gas pumping apparatus 10 of the present invention permit the construction of a wall pump that can pump a space continuously and be reactivated without interrupting such pumping or exposing the space to undesirable contamination by captured gases liberated from the wall pump during reactivation. The gas pump apparatus 10 is illustrated in FIG. 1 as having a particular organization and form of elements as well as a particular operating relationship with the space 20 being pumped. As shown in FIG. 1, the space 20 is defined by the walls of a vessel 40 and the gas pump apparatus 10 is depicted as having elongated gas pumping assemblies 14 desposed within an area set aside in the space 20 for housing the assemblies. However, there is no limitation respecting the configuration, dimensions or numbers of the gas pumping assemblies (other than the space available for their location and needed capacity of the pumping apparatus) and the gas pump apparatus 10 may be fabricated as a wall pump, an appendage pump or in any other desired form. In the embodiment illustrated in FIG. 1, the gas pump apparatus 10 of the present invention is configured as a wall pump disposed within the vessel 40 defining the space 20 to be pumped. To accommodate the wall pump apparatus 10 of the present invention, the vessel 40 is constructed to provide the required additional area necessary to house the gas pumping assemblies 14 and related components of the gas pump apparatus, such as coolant reservoirs 32 and 34, shrouds 44 and 46, coolant ducts and collector pump 23.

As briefly discussed hereinbefore, the gas pump apparatus 10 of the present invention includes a plurality of gas pumping assemblies 14, each including a plurality of gas pumping members 18 protected by thermal shield members 16 (FIGS. 2A and 2B). The gas pumping members 18 of at least one of the gas pumping assemblies 14 are isolated from the pumped space 20 for reactivation by the shield members 16, while gas pumping members 18 of the other assemblies 14 remain in gas flow communication with the space for continued pumping of the space unaffected by the reactivation of the isolated pumping members. With reference to FIGS. 2A and 2B, it is seen that sections 16*a* of each shield member 16 are movable between two positions, one of which exposes the gas pumping member 18 located between adjacent shields 16 to the space 20 being pumped (FIG. 2A) and the other of which isolates the pumping member 18 from the space 20 (FIG. 2B). The other section 16*b* of each shield member 16 is stationary and cooperates with the movable and stationary sections 16*a* and 16*b* of adjacent shield members 16 to form a substantially gas tight enclosed zone 42 around the gas pumping member 18 when it is desired to reactivate that member. It is not necessary to provide a gas impervious seal between the isolated zone 42 and space 20. The gas seal need only be sufficient to prevent backflow from zone 42 to the space 20 that produces an objectionable change in the steady state pressure condition of the space 20. In large plasma confinement chambers operated at a steady state pressure on the order of $1\times10^{-8}$ torr or less, a change in pressure due to backflow leakage by a factor of two usually is considered insignificant and tolerable. When used herein, therefore, the phrase gas tight has the foregoing meaning, unless the context demands otherwise. As will be described in further detail hereinafter with reference to the preferred embodiment of the gas pump apparatus 10 of the present invention illustrated in FIGS. 3–9, the shield members 16 are arranged in the preferred embodiment to perform two functions. One of the functions, which has been just described, is to isolate the gas pumping members 18 in zones 42 during the reactivation of the gas pumping members. The second function is to shield the gas pumping members from thermal radiation from the surroundings. To satisfy this latter purpose, the shield members 16 are constructed of good thermally conductive material and are located between the gas pumping members 18 and the space 20 to intercept thermal radiation from the space and prevent it from falling directly on the gas pumping members. In the preferred embodiment, shield members 16 have a black or absorbing surface coating facing the space 20 and a reflective or no surface coating facing gas pumping members 18. This increases absorbtion of thermal radiation from space 20 without increasing thermal radiation to members 18.

FIGS. 2A and 2B are end views of one gas capture pumping member 18 and adjacent shield members 16 of one gas pumping assembly 14. Opposite ends of the members 16 and 18 extend to gas collecting shrouds 44 and 46 (best seen in FIGS. 4 and 7) and are coupled to them to form a gas tight seal between the interior defined by each of the shrouds 44 and 46 and the space 20. The shrouds 44 and 46 cooperate with the shield members 16 to prevent backflow leakage from the isolated zones 42 to the space 20 at the ends of the gas pumping members 18 during their reactivation. In addition, the gas lower collecting shroud 46 associated with each pumping assembly 14 serves as a gas conduit for the gases which are liberated during reactivation operations, the conduit extending between the enclosed zones 42 and the gas collector pump 23 (FIG. 1) via the isolation valve 25. As described briefly hereinbefore and will become more apparent upon consideration of the more detailed description hereinafter with reference the preferred embodiment of the gas pump apparatus 10 illustrated by FIGS. 3–9, particular advantages are realized by arranging a plurality of gas pumping assemblies 14 so that gas pumping members 18 of some of the assemblies are exposed to the space 20 for pumping, while gas pumping members 18 of other assemblies are enclosed by surrounding shield members 16 and isolated from the space 20 for reactivation.

Referring not to FIGS. 3–6, a preferred embodiment of one of the gas pumping assemblies 14 the gas pump apparatus 10 of the present invention is shown as arranged to evacuate and maintain a steady state vacuum for a prolonged period in a space 20 suited for controlled thermonuclear fusion reactions. Each gas pumping assembly 14 includes a plurality of gas capture pumping members 18. Each gas pumping assembly 14 is operable independently of the other assemblies to enable regeneration of the gas pumping members 18 of one of the assemblies while the gas pumping members 18 of the other assemblies continue to pump the evacuated space 20.

Figure 5:
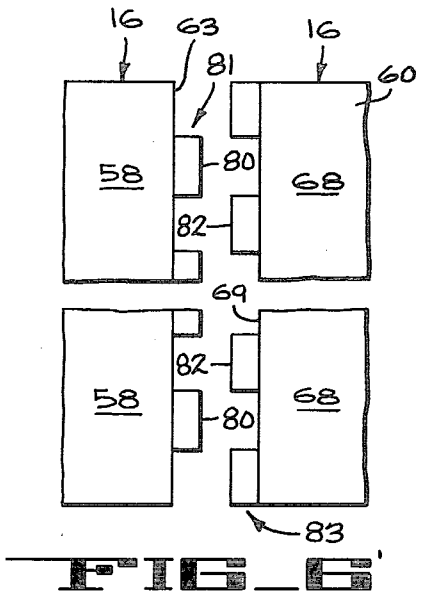
FIG. 5 is a cross sectional top view of the gas pump apparatus of the present invention, partially in cross section and interrupted along its length, taken on the plane indicated by lines 5—5 in FIG. 4.

The construction details of the thermal shield members 16 and gas capture pumping members 18 forming the gas pumping assemblies 14 are best seen in FIG. 5. As discussed hereinbefore, only the gas capture pumping members 18 are reactivated in the preferred embodiment of the gas pump apparatus 10. Each gas pumping member 18 includes a pair of long rectangular thin aluminum panels 50 and 52 joined at opposite sides of a cylindrical aluminum coolant tube 54 that conveys cooling fluid to the pumping member 18. The panels and coolant tube of, each gas pumping member 18 can be fabricated separately and joined together, for example as by welding, to form a good thermally conductive connection between the panels and coolant tube. Alternatively, the two panels 50 and 52 and coolant tube 54 of each gas pumping member 18 can be fabricated as an unitary body, for example, as an extrusion. As will be described in further detail hereinafter, liquid helium is conveyed through tube 54 to cool the panels 50, 52 to a temperature that facilitates the capture on panel surfaces by condensation gases found in the space 20 being evacuated.

At a short distance from each side of each gas pumping member 18 is a flanking thermal shield member 16. Each thermal shield member 16 includes three long rectangular thin aluminum panels 58, 60 and 62 disposed in a generally Z-shaped folded or corrugated—like pattern that eliminates all line-of-sight paths between the space 20 being pumped and the gas pumping member 18 located between adjacent shield members 16. This prevents any radiation from the space 20 from falling directly on the gas pumping members 18. The three panels are disposed in a side-by-side relation, with the center panel 60 stationary and the two flanking outer panels 58 and 62 pivotally joined at the opposite sides 64 and 66 of the center panel 60. The center panel 60 includes two sections 68 and 70 joined by welding at opposite sides of a cylindrical aluminum coolant tube 72 to form a good thermally conductive connection with the tube. As described hereinbefore with respect to the gas pumping members 18, the coolant tube 72 and two sections 68 and 70 can be fabricated separately and joined together by welding or fabricated as an unitary body as an extrusion. As will be described in further detail hereinafter, liquid nitrogen is conveyed through tube 72 to cool the three panels 58, 60 and 62 to a temperature that facilitates the thermal shielding of the gas pumping members 18. Although not a principal purpose of the shields, cooling of the panels 58, 60 and 62 with liquid nitrogen conditions the panels to capture gases by condensation as well.

Each of the outer panels 58, 62 of each thermal shield members 16 is pivotally joined to the stationary panel 60 so as to be movable between two positions; a first of the positions exposing the gas pumping member 18 for pumping the space being evacuated and the second of the positions isolating the member 18 from the space for reactivation. As can be seen by the phantom line representations 74 and 76 in FIG. 5 illustrating the panels 58 and 62, respectively, placed in their second positions, the movable panels of each shield member 16 are movable in opposite directions relative to stationary panel 60. Consequently, a movable panel 58 of a shield member 16 at one side of the flanked adjacent shield member 18 cooperates with a movable panel 62 of a different gas pumping member 16 disposed to flank the opposite side of the gas pumping member 18 to effect isolation of the flanked gas pumping member 18. The panels 58, 60 and 62 are depicted in FIG. 5 in the first position that exposes the gas pumping member 18 for pumping the space. The phantom line representations 74 and 76 in FIG. 5 depict the movable panels 58 and 56, respectively, in their second positions that isolate the flanked gas pumping member 18 for reactivation.

Figure 6:
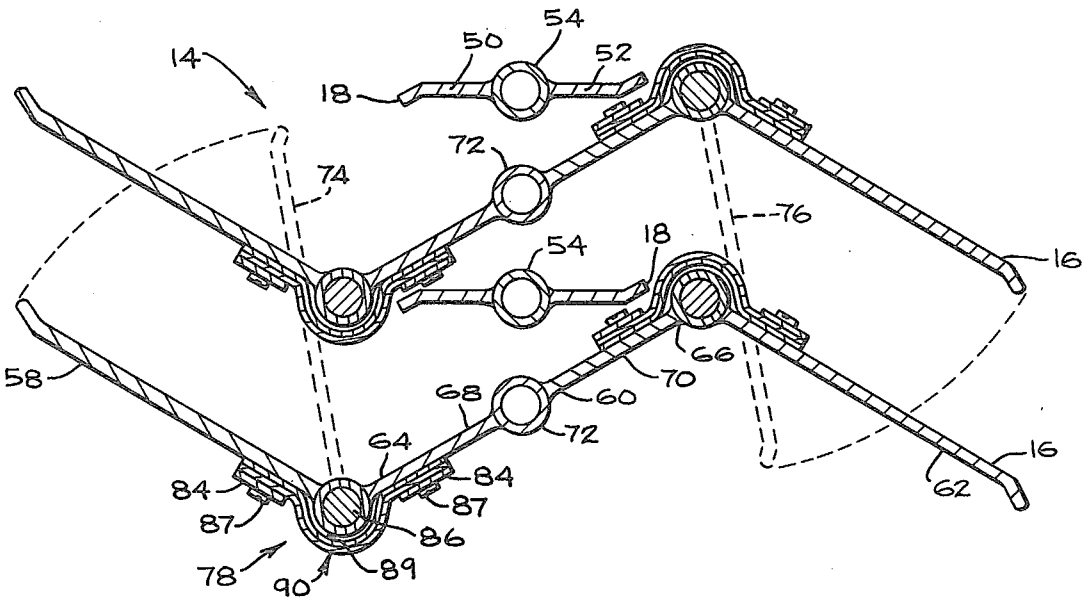
FIG. 6 is a schematic diagram of a portion of the thermal shield members employed in the gas pump apparatus of the present invention illustrating the construction of the hinge joining the parts of the thermal shield members.

In the preferred embodiment, each of the movable panels 58 and 62 is joined to the flanked stationary panel 60 for pivotal movement between the aforedescribed exposing and isolating positions by a hinge 78. More particularly, and with reference to FIGS. 5 and 6, each hinge 78 is formed of segments of tubes 80 and 82 welded to the facing edges of stationary and movable panels of the thermal shield member 16. FIG. 6 illustrates the hinge 78 joining the stationary center panel section 68 of the center panel 60 to the adjacent movable panel 58. The tube segments 80 joined to the movable panel 58 are aligned along the edge 63 of the panel to form a hinge barrel 81 and the tube segments 82 joined to the stationary center panel section 68 of the center panel are aligned along the edge 69 of the panel section to form a hinge barrel 83. The two hinge barrels 81 and 83 are coupled together by a pivot pin 86, preferably of brass, passing through the aligned hinge barrels.

To facilitate maintaining the movable panels 58 and 62 at a low temperature and, thereby, aid in the suppression of radiation of thermal energy by the thermal shield members 16, particularly, to the gas pumping members 18, opposite ends of one or more layers of highly conductive aluminum foil forming a mat 90 (FIG. 5) are interposed between pressure plates 84 and 86 and the movable and stationary shield panels, e.g., 58 and 60, to which the pressure plates are respectively secured. The lengths of the layers of aluminum foil forming the mat 90 are selected to provide sufficient slack, represented by the space 89 between the mat 90 and hinge 78, when the movable shield panels 58 and 62 are in the positions shown in FIG. 5 so that the panels 58 and 62 can be moved to the positions represented by the phantom lines 74 and 76 for isolating the gas pumping members 18 without tearing apart the layers of aluminum foil forming the mat 90. Good thermally conductive connection between the stationary panel 60 and each of the outer hinged movable panels 58 and 62 is achieved by tightening the pressure plates 84 against the panels with bolts 87 provided this purpose, which pass through the pressure plates to engage the panels.

Figure 3:
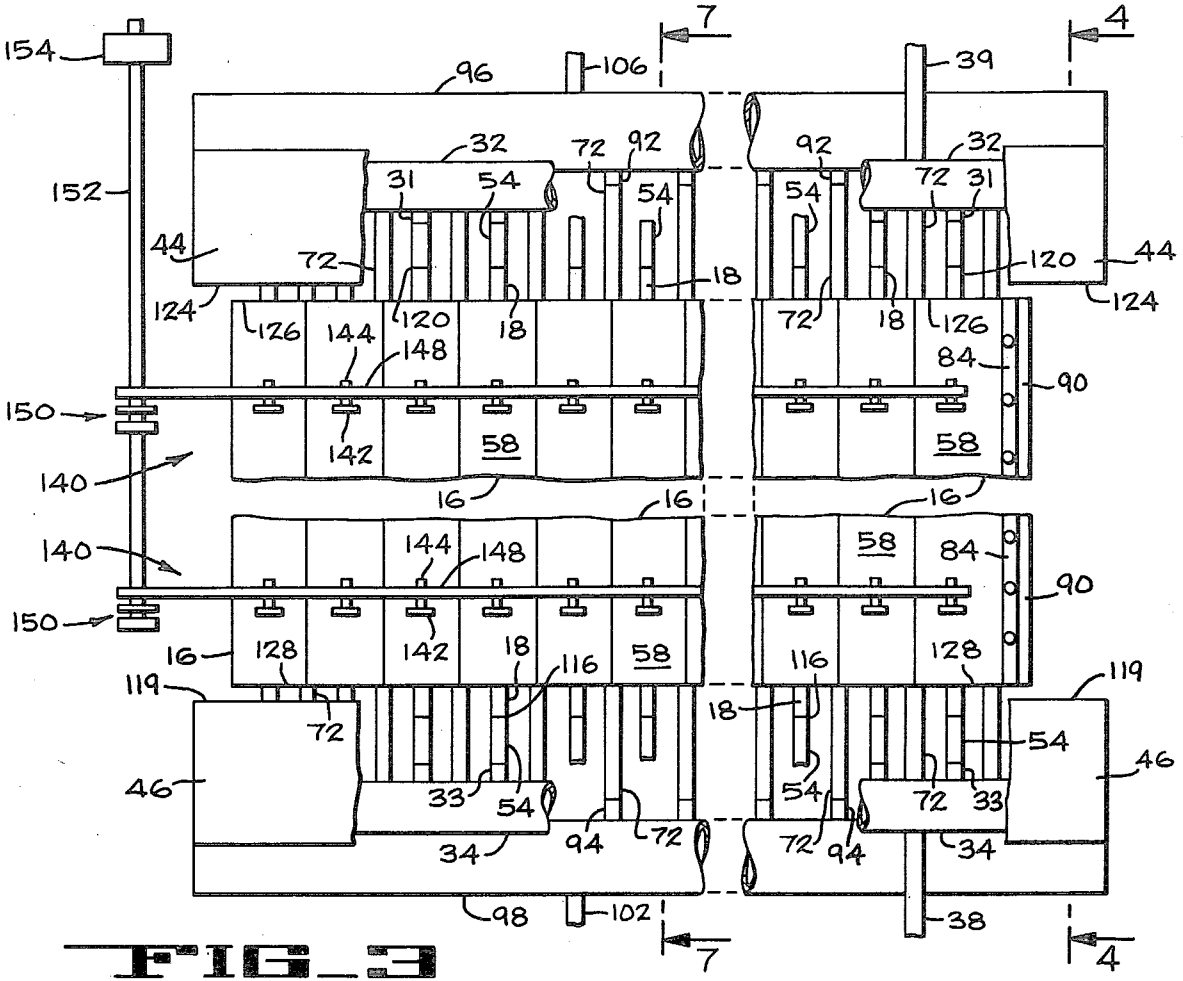
FIG. 3 is a front elevation view of a preferred embodiment of the gas pump apparatus of the present invention, having partially broken away portions and interrupted along its length and width to facilitate its illustration.
Figure 4:
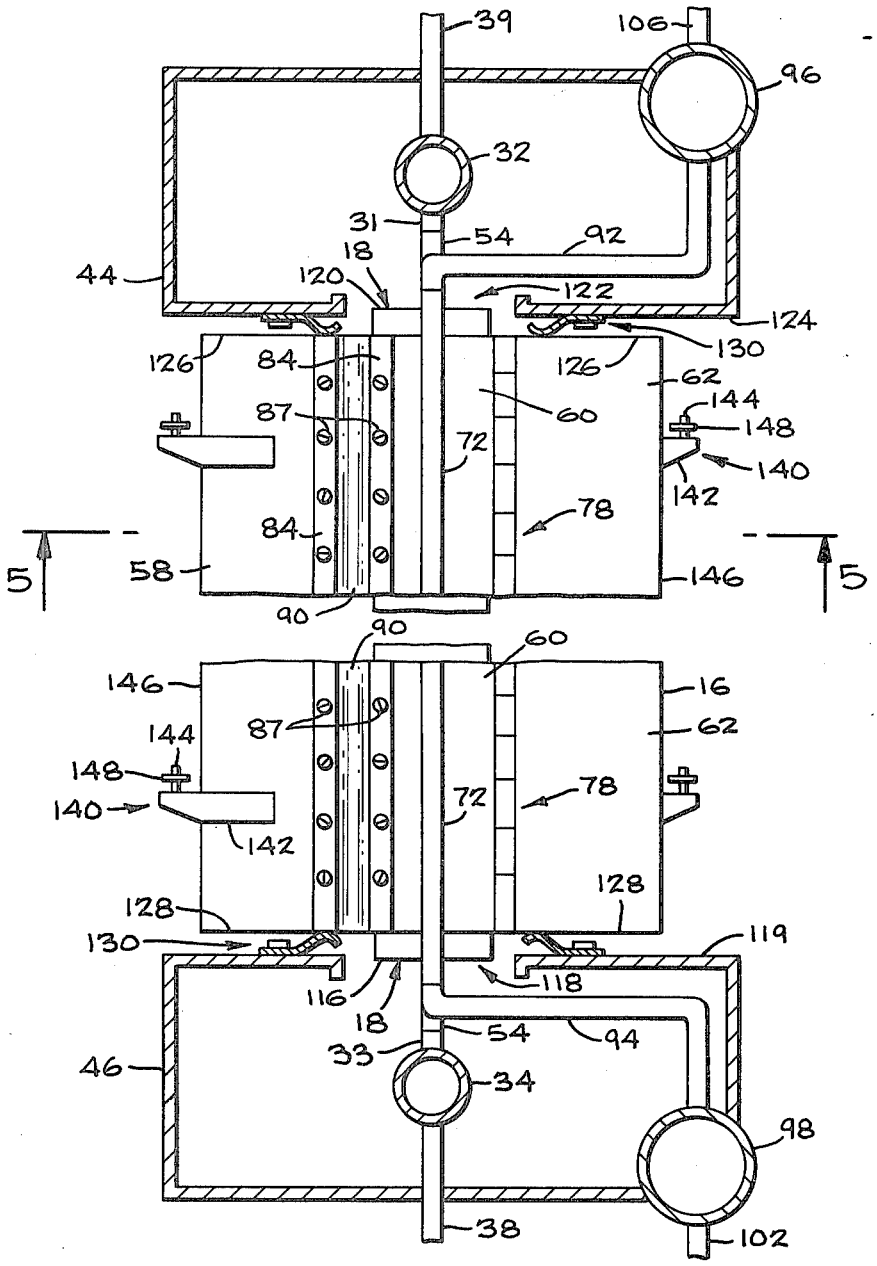
FIG. 4 is a side elevation view of the gas pump apparatus of the present invention taken on the plane indicated by lines 4—4 in FIG. 3.

As briefly discussed hereinafter, several gas capture pumping members 18 and thermal shield members 16 are alternatingly distributed along a line to form a gas pumping assembly 14. Attention is now directed to FIGS. 3 and 4 for a discussion of the manner in which the shield and gas pumping members 16 and 18 are supported to form each of the pumping assemblies 14. As described hereinbefore, the preferred embodiment of the gas pump apparatus 10 of the present invention is constructed to pump a large plasma confinement vessel 40 and maintain a pressure therein on the order of $1\times10^{-8}$ torr. For such applications, each gas pumping assembly 14 is arranged to have on the order of fifteen to twenty gas pumping members 18. The coolant tubes 54 and 72 are employed to support the gas pumping and shield members 18 and 16 of the gas pumping assembly 14. More specifically, the tubes 54 extend between the coolant ducts 31 and 33 associated with the two liquid helium manifolded local reservoirs 32 and 34 and the tubes 72 extend between the coolant ducts 92 and 94 associated with the two liquid nitrogen manifolded reservoirs 96 and 98. Each gas pumping assembly 14 includes its own two helium and nitrogen reservoirs. The lower most manifolded reservoirs 34 and 98 serve as inlet reservoirs and are coupled, respectively, by coolant ducts 38 and 102 to associated coolant storage tanks (not shown). The upper most manifolded reservoirs 32 and 96 serve as vent reservoirs and are coupled, respectively, by gas ducts 39 and 106 to a gas pressure source (not shown).

Figure 7:
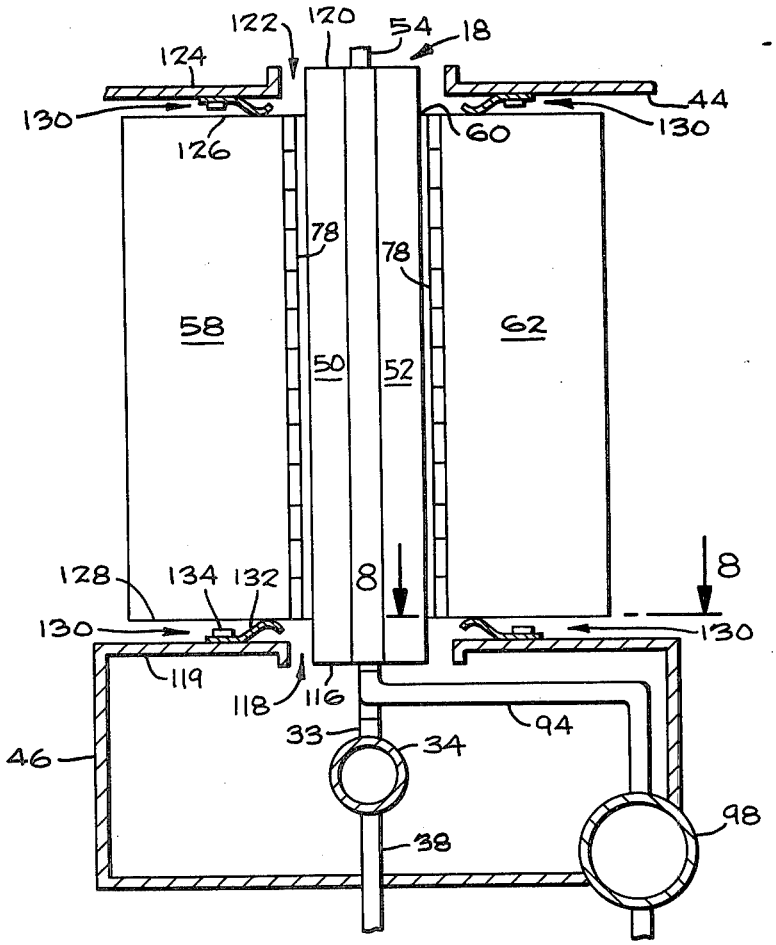
FIG. 7 is a schematic diagram of a cross-sectional side elevation view of the gas pump apparatus of the present invention taken on the plane indicated by lines 7—7 in FIG. 3, with parts omitted to facilitate the illustration of the relationship between the thermal shield members and the gas pump members.
Figure 8:
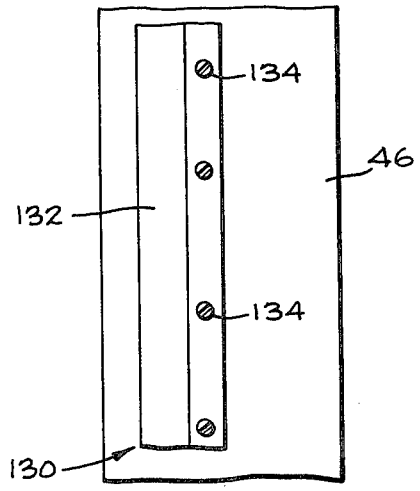
FIG. 8 is a cross sectional view of a part of the gas pump apparatus of the present invention taken on the plan indicated by lines 8—8 of FIG. 7.
Figure 9:
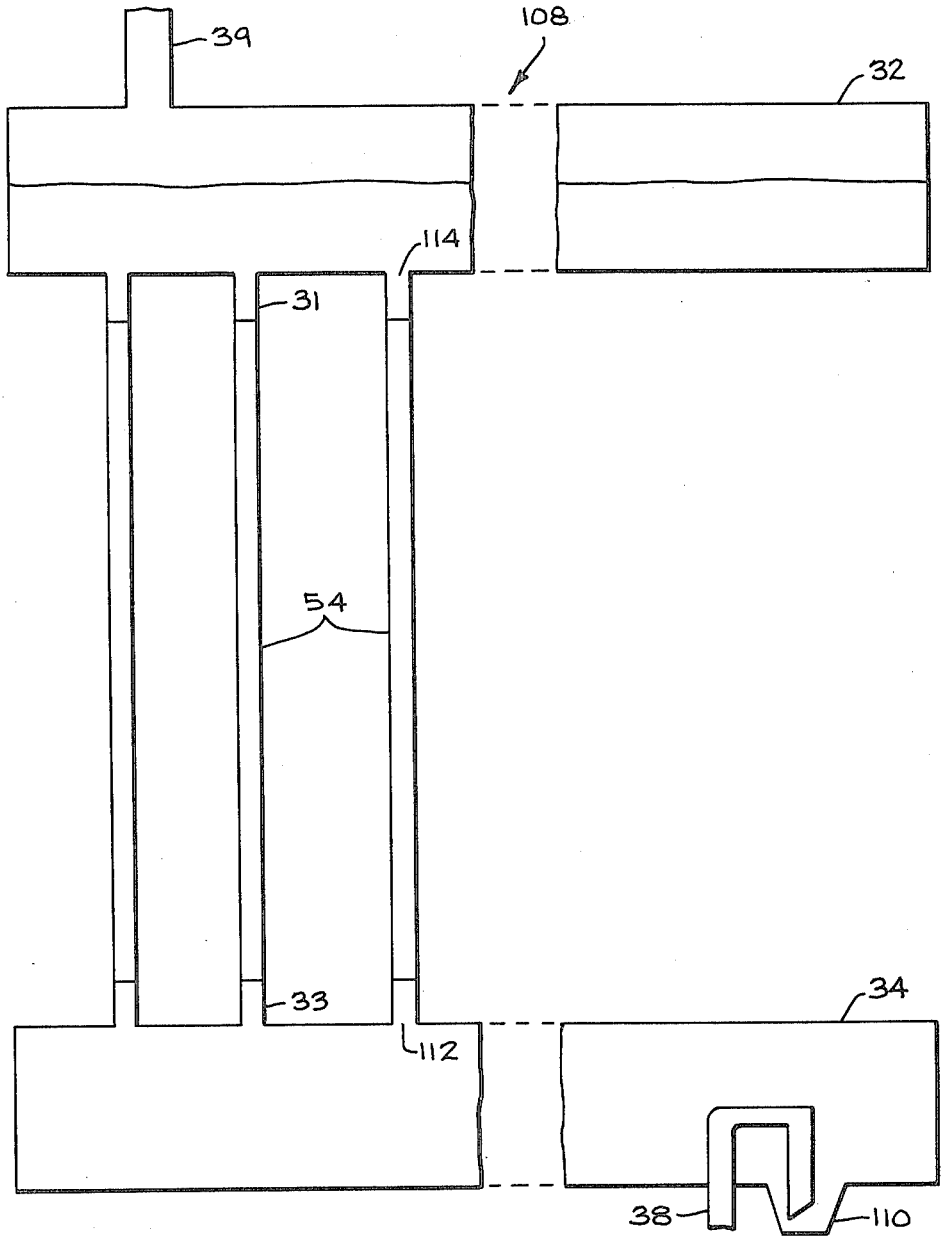
FIG. 9 is a schematic diagram of the coolant system employed to control cooling and reactivation of the gas pumping members determining and maintaining the final pressure of the space evacuated by the gas pump apparatus of the present invention.

The manner in which the liquid coolant is delivered to and is purged from the gas pumping assembly 14 and the various components of the assembly are cooled can be understood by reference to FIGS. 7–9.

As described hereinbefore with reference to FIGS. 1 and 2, the gas pumping members 18 are filled by liquid helium coolant supplied from the coolant storage tanks and is purged of liquid coolant by pressurizing the vent reservoir 32 with a gaseous form of the coolant supplied from the gas pressure source via coolant duct 39. FIG. 9 schematically illustrates the coolant system 108 for supplying liquid helium to and purging liquid helium from the gas capture pumping members 18. As seen in FIG. 9, liquid helium coolant is received by the inlet manifolded reservoir 34 from the coolant storage tank via the coolant duct 38, which opens into the inlet reservoir at a depression 110 in the lower wall of the reservoir. The received coolant first fills the inlet reservoir 34, after which it flows into the coolant ducts 33 and coolant tubes 54 associated with the stationary gas capture pumping members 18. The coolant tubes 54 are secured at their opposite ends in a suitable liquid tight manner to the coolant ducts 31 and 33 of the manifolded reservoirs 32 and 34 to receive or deliver coolant through the manifold openings 112 and 114, respectively, of the two reservoirs. After the coolant tubes 54 are filled, the liquid helium enters the manifolded vent reservoir 32 to partially fill that reservoir. When it is desired to purge the coolant tubes 54 of liquid helium, for example, during reactivation of the gas pumping members 18, gaseous helium under a suitable pressure is delivered by the duct 39 to the manifolded vent reservoir 32. The pressurization of the coolant system 108 drives the coolant out of the coolant tubes 54 and inlet reservoir 34 through the coolant duct 38 and back to the coolant storage tanks. Driving the coolant out of the coolant tubes 54 permits the temperature of the associated gas pumping members 18 to rise and thereby free captured gases therefrom. As described hereinbefore, with reference to FIGS. 1 and 2, the coolant system 108 is employed in the preferred embodiment of the gas pump apparatus 10 of the present invention to effect reactivation of the gas pumping members 18.

The liquid nitrogen cooling system for the thermal shield members 16 is similarly arranged and operated to deliver nitrogen coolant to the coolant tubes 72 (FIGS. 3 and 4) of the thermal shield members and purge the coolant therefrom. The coolant duct 106 of the upper nitrogen vent reservoir 96 is coupled to a pressurized nitrogen gas source (not shown) through suitable isolation valves (not shown), which are operated to purge the liquid nitrogen from the thermal shield members 16 in the manner described hereinbefore with reference to FIG. 9 and the gas pumping members 18. Liquid nitrogen coolant is delivered to the thermal shield members via the coolant duct 102 of the lower nitrogen inlet reservoir 98. This coolant duct is coupled to a liquid nitrogen coolant source (not shown) via a suitable isolation valve (not shown), which are operated to deliver liquid nitrogen coolant to the thermal shield members 16 in the manner described hereinbefore with reference to FIG. 9 and the gas pumping members 18.

As described hereinbefore with reference to FIGS. 1 and 2, the shrouds 44 and 46 serve to prevent undesirable backflow to the space 20 being pumped of gases liberated from the gas pumping members 18 during their reactivation and to collect and conduct the liberated gases to the exhaust system associated with the gas pumping assembly 14. Referring again to FIGS. 3 and 4, the lower end 116 of each gas pumping member 18 extends into the lower shroud 46 through an opening 118 extending the length of the top wall 119 of the shroud. Similarly, the upper end 120 of each gas pumping member 18 extends into the upper shroud 44 through an opening 122 extending the length of bottom wall 124 of the shroud. The upper end 126 of each of the movable panels 58 and 62 of each shield member 16 extends to just below the bottom wall 124 of the upper shroud 44 and the lower end 128 of each of the movable panels of each shield member extends to just above the top wall 124 of the lower shroud 46. As will be appreciated from the description hereinafter of the reactivation of the gas pumping members 18, adequate isolation of the interiors of the shrouds 44 and 46 from the space 20 can be achieved if the separation between the ends 126 and 128 of the movable panels 58 and 62 and the adjacent walls 124 and 119 of the shrouds 44 and 46, respectively, is small enough so that the gas conductance through the separation is much smaller than the gas conductance from the shrouds to the exhaust system. However, isolation of the interiors of the shrouds 44 and 46 is facilitated through the provision of sliding gas seal members 130 between the shrouds 44 and 46 and the ends 126 and 128, respectively, of each of the movable panels 58 and 62 of each thermal shield member 16.

A preferred embodiment of a sliding gas seal member 130 as arranged for use in the gas pumping assembly 14 of the present invention is illustrated in FIGS. 7 and 8. Each seal member 130 includes a flexible metal strip 132, e.g., of brass, secured by several bolts 134 to the shroud to engage in sliding contact the facing end of the movable panel. The flexible metal strips 132 extend the length of the shrouds 44 and 46, respectively, and are located on the shrouds to always engage the movable panels 58 and 62, regardless of their positions. In this manner, the flexible metal strips 132 form a high impedance gas flow path between the interiors of the shrouds 44 and 46 and the space 20 being pumped.

During the regeneration of the gas pumping members 18, the members are isolated from the high vacuum space 20 by moving the movable panels 58 and 62 (FIG. 5) of the shield members 16 to the second position, which forms a gas tight zone 42 (FIG. 2B) around the members 18. Liquid helium is then purged from the coolant system 108 (FIG. 9), which liberates the gas captured by the members 18. The liberated gas enters the shroud 46 for collection by collector pump 23 via isolation valve 25 (FIG. 1) and eventual exhausting to an exterior gas recovery system. The manner in which this reactivation and exhausting of the captured gas liberated from the gas pumping members can be better understood by reference to FIGS. 4 and 7. As the liquid helium is purged from the gas pumping members 18, it is first driven out of the vent reservoir 32 (FIG. 4) located within the upper shroud 44 and then progressively along the coolant tube 54 of each gas pumping member 18, from the top of the coolant tube to its bottom coupled to the inlet reservoir 34 located within the lower shroud 46. As the liquid helium coolant is progressively forced out of the coolant tube 54, the temperature of the gas pumping member 18 increases progressively along its length. This causes the condensed gas to be desorbed and move downward along the length of the gas pumping member 18 toward the lower shroud 46 with some gas recondensing at locations where the liquid helium coolant has not yet been driven from coolant tube 54. This desorbing and recondensing of the captured gas continues along the length of each gas pumping member 18 until the entire length of its coolant tube 54 is purged of liquid helium coolant. The desorbed gas then moves through the lower shroud 46 from the lower end 116 of the gas pumping member 18 extending into the lower shroud through the opening 118 in the top wall 119 of the shroud. As seen in FIGS. 4 and 7, the two shrouds 44 and 46 are joined as by welding in a good thermal conducting relationship to the liquid nitrogen reservoirs 96 and 98, respectively, so that the shrouds are maintained at a low temperature. In addition to suppressing radiation of thermal energy to the gas pumping assembly 14, maintaining the lower shroud 46 at a low temperature determined by the lower liquid nitrogen reservoir 98 facilitates establishing a high gas conductance through the shroud to the collector pump 23 (FIG. 1). The collector pump 23 pumps the gas from the lower shroud 46 through the opened isolation valve 25 for subsequent exhausting through the exhaust duct 22 and exhaust valve 24.

Referring again to FIGS. 3–5, the movable panels 58 and 62 of the thermal shield members 16 are moved by overcenter toggle linkage mechanisms 140 between the positions for exposing the gas pump members 18 to the space 20 (the positions in which they are illustrated in FIG. 5 and shown in FIG. 2A) and the positions for isolating the gas pump members from the space in zone 42 (the positions illustrated by the phantom lines 74 and 76 in FIG. 5 and shown in FIG. 2B). More specifically, each of the movable panels 58 and 62 is joined at two spaced locations along its extent to a pair of pivot connecting support members 142, the pair of support members of each movable panel being aligned with the pairs of support members of the other movable panels on the same side of the gas pumping assembly 14. Each aligned support member 142 supports a pivot pin 144 away from the outer edge 146 (FIG. 4) of each panel. The aligned pivot pins 144 are seated in a control rod 148 so as to permit rotational movement between the rod and pins as the movable panels are moved from one position to another. The control rods 148 extend the length of the gas pumping assembly and are communicated to the exterior of the space being pumped via a pivoting union 150 and rotatable shaft 152 extending through a common Wilson seal 154. Movement of the control rods 148 back and forth is accomplished by rotating the shaft 152, either manually or by a motor, which in turn results in moving the movable panels coupled thereto between the two, aforedescribed positions for exposing and isolating the gas pumping members 18. It will be appreciated that the control rods operatively linked to the movable panels 58 and 62 are moved conjointly, but in opposite directions. Moreover, the control rods 148 associated with the gas pumping assembly 14 whose gas pumping member 18 are to be reactivated are operated to place the movable panels 58 and 62 of the thermal shield members in positions that isolate the gas pumping members in zones 42 (FIG. 2B). At the same time, the control rods 148 associated with the other gas pumping assemblies 14 of the gas pump apparatus whose gas pumping members are to pump the space 20 are operated to place the movable panels 58 and 62 of such assemblies in positions that expose the gas pumping members to the space (FIG. 2A).

Advantageous prolonged continued pumping of a space to maintain a desired steady state pressure is readily achievable by the gas pump apparatus 10 of the present invention. Such pumping is preferrably accomplished by selecting the size and number of gas pumping assemblies 14 in accordance with the desired quantity of gas to be pumped from a space and desired rate of gas pumping whereby the gas capture pumping members 18 of the different assemblies are reactivated in sequence and the space is always exposed to gas pumping members capable of efficiently pumping the space to maintain the desired steady state pressure.

While the gas pump apparatus of the present invention has been described in detail in connection with a preferred embodiment arranged to pump high vacuum equipment, it will be appreciated by those skilled in the art that various changes and modifications can be made in adapting the invention to such uses or other different ones where it is desired to pump gas from a space. Therefore, it is intended that the scope of the invention not be limited other than by the terms of the following claims.

What we claim is:

1. A gas pump apparatus for pumping gas from an enclosed space; comprising:

first means defining at least one area in gas flow communication with said space;

a plurality of first members disposed in said area, each first member having a gas pumping surface for capturing gas;

second means for selectively isolating said gas pumping surfaces in said area from gas flow communication with said space and exposing said gas pumping surfaces in said area to gas flow communication with said space;

third means for controlling said second means to selectively isolate a number less than all of said gas pumping surfaces from and simultaneously expose all other gas pumping surfaces to gas flow communication with said space;

said second means including a plurality of second members impervious to gas disposed in said area and mounted for movement therein between first and second positions;

each first member being positioned in a zone within said area and in relation to the second members to be confined in said zone by second members isolated from gas flow communication with said space when the confining second members are in the first position and to be exposed in said zone by the confining second members to gas flow communication with said space when the confining second members are in the second position;

said third means controlling the movement of said second members between the first and second positions to position a number less than all of said second members in the first position to confine a number less than all of said gas pumping surfaces and simultaneously position all other second members in the second position to expose all other gas pumping surfaces;

each first member including a first panel defining a length and an exposed surface extending its length that forms the gas pumping surface;

each second member including a second panel impervious to gas;

each second panel defining a length and is disposed in said area spaced from and adjacent to another second panel to define a zone between the adjacent second panels extending the length of the adjacent panels;

each first panel being positioned in the zone between adjacent second panels;

each second panel having stationary and movable sections extending its length with each movable section pivotally secured relative to the stationary section for movement between the first and second positions, the stationary and movable sections of adjacent second panels forming an enclosure confining the first panel positioned in the zone between the adjacent second panels when the movable sections are in said first position and forming a path for gas flow communication between said space and the first panel positioned in said separate zone when the movable sections are in said second position; and said third means controlling the movement of the movable sections of the second panels between the first and second positions to position a number less than all of said movable sections in the first position and simultaneously position all other movable sections in the second position.

2. The gas pump apparatus of claim 1 wherein the gas pumping surfaces of said first members are gas condensing surfaces.

3. The gas pump apparatus of claim 2 wherein the second members are thermal shields positioned relative to said space and said first members to prevent thermal radiation from the space from falling directly on the gas condensing surfaces of said first members.

4. The gas pump apparatus of claim 1 wherein each second panel includes two movable sections pivotally secured to the stationary section at opposite edges along the length of said stationary section.

5. The gas pump apparatus of claim 1 wherein the gas pumping surfaces of said first panels are gas condensing surfaces, and the second panels are thermal shields positioned relative to said space and said first panels to prevent thermal radiation from the space from falling directly on the gas condensing surfaces of said first panels.

6. The gas pump apparatus of claim 5 wherein said first means is a vessel defining an enclosed region including said enclosed space and said area, said first and second panels are disposed within said vessel in said area.

7. The gas pump apparatus of claim 1 wherein the gas pumping surfaces of said first members are gas condensing surfaces, the second members are thermal shields positioned relative to said space and said first members to prevent thermal radiation from said space from falling directly on the gas condensing surfaces, and further comprising:

means for maintaining said gas condensing surfaces of said first members at a temperature conductive to the capture of condensable gas in said space;

means for altering the temperature of the gas condensing surfaces while isolated in the area to free captured gases therefrom;

means for removing the gases freed from gas pumping surfaces isolated in the area to a place other than said area and said space; and means for maintaining said second members at a temperature to suppress the radiation of heat to the first members.

8. The gas pumping apparatus of claim 1, further comprising:

means for reactivating gas pumping surfaces while isolated in the area whereby captured gases are freed from said surfaces; and means for removing gases freed from gas pumping surfaces isolated in said area to a place other than said area and said space.

9. The gas pump apparatus of claim 1 wherein the gas pumping surfaces exposed to gas flow communication with said enclosed space define a gas capture capacity capable of maintaining the enclosed space at a selected pressure, and the gas pumping surfaces isolated from gas flow communication with said enclosed space define an excess gas capture capacity equal to a fraction of the gas capture capacity defined by the gas pumping surfaces exposed to gas flow communication with said enclosed space.

10. The gas pump apparatus of claim 9 wherein the third means controls said second means to isolate all gas pumping surfaces in groups in a staggered sequence with each group defining said fraction of the gas capture capacity while simultaneously exposing in the staggered sequence groups of the gas pumping surfaces previously isolated from gas flow communication with said enclosed space, and the gas capture capacity defined by the gas pumping surfaces exposed to gas flow communication with said enclosed space and the gas capture capacity defined by the gas pumping surfaces simultaneously isolated from gas flow communication with said enclosed space are selected to maintain the enclosed space at the selected pressure as the groups are isolated and exposed in the staggered sequence.

11. A gas pump apparatus for pumping gas from an enclosed space; comprising:

means defining at least one area in gas flow communication with said space;

a plurality of first members disposed in said area, each first member including a first panel having gas condensing surfaces extending between first and second opposite ends of said first panel and a first tube for conveying a coolant, said first panel secured to said first tube to have its gas condensing surfaces cooled by coolant conveyed through said tube;

a plurality of second members disposed in said area, each second member including a second panel extending between first and second opposite ends and a second tube for conveying coolant, said second panel secured to said second tube to be cooled by coolant conveyed through said tube, each second member positioned in said area with its second panel spaced apart and adjacent to the second panel of another second member to define a zone between the adjacent second panels in which at least one first panel is located, each second panel having stationary and movable sections with each movable section secured relative to the stationary section for movement between first and second positions, the stationary and movable sections of adjacent second panels forming an enclosure isolating the first panel located between said adjacent second panels from gas flow communication with said space when the movable sections are in said first position and forming a path for gas flow communication between said space and the first panel located between said adjacent second panels when the movable sections are in said second position;

means for controlling the movable sections of said second panels to selectively position a number means for controlling the movable sections of said second panels to selectively position a number less than all of said movable sections in said first position and simultaneously position all other movable sections in said second position;

a first reservoir for coolant coupled to convey the coolant through the first tubes of said first members and cool the first panels to a first temperature;

a second reservoir for coolant coupled to convey coolant through the second tubes of said second members and cool the second panels to suppress thermal radiation therefrom;

means for purging coolant from the first tubes of the first members selectively to permit increasing the temperature of first panels secured to said purged first tubes to free captured gas from the gas condensing surfaces;

a first shroud enclosing the first ends of the first panels to isolate said first ends from said space;

a second shroud enclosing the second ends of the first panels to isolate said second ends from said space; and means coupled to one of the first and second shrouds for removing gases from said shroud.

12. The gas pump apparatus of claim 11 wherein the second panels are positioned relative to said space and said first panels to prevent thermal radiation from the space from falling directly on the gas condensing surfaces of said first panels.

13. The gas pump apparatus of claim 12 wherein said means defining at least one area is a vessel defining an enclosed region including said enclosed space and said area, said first and second members and said first and second shrouds disposed within said vessel in said area.

14. The gas pump apparatus of claim 11 wherein each second panel includes first and second movable sections separated by said stationary section, said movable and stationary sections extending between the first and second opposite ends of said second panel terminating proximate the exterior of the first and second shrouds respectively, and further comprising means for impeding gas flow between each opposite end of each second panel and proximate shroud.

15. The gas pump apparatus of claim 14 wherein said means for impeding gas flow includes a strip of gas impervious material secured to each movable section and each stationary section of each second panel at each of first and second opposite ends thereof and extending to engage the proximate shroud, each strip secured to said movable section engaging the proximate shroud in sliding contact.

* * * * *